United States Patent [19]

Baylis

[11] Patent Number: 4,767,423

[45] Date of Patent: Aug. 30, 1988

[54] VARIABLE INTENSITY RAPPING

[75] Inventor: Alan P. Baylis, Walsall, England

[73] Assignee: Dresser U.K. Limited, A British Company, London, England

[21] Appl. No.: 7,208

[22] Filed: Jan. 27, 1987

[30] Foreign Application Priority Data

Jan. 30, 1986 [GB] United Kingdom ..... 8602308

[51] Int. Cl.[4] ..... B03C 3/76

[52] U.S. Cl. ..... 55/112

[58] Field of Search ..... 55/112, 13

[56] References Cited

U.S. PATENT DOCUMENTS 4,519,817 5/1985 Gibbons ..... 55/112

FOREIGN PATENT DOCUMENTS

80/2118 10/1980 World Int. Prop. O. .

*Primary Examiner*—Bernard Nozick

*Attorney, Agent, or Firm*—Roy L. Van Winkle

[57] ABSTRACT

Variable intensity rapping device for use in electrostatic precipitators include means for a mechanism increasing the force with which a drop rod impacts its associated anvil. This mechanism may include a spring or as shown a drop hammer which may be located for operation or swung into an inoperative position by a quarter turn of a drive shaft.

7 Claims, 2 Drawing Sheets

VARIABLE INTENSITY RAPPING

This invention relates to the rapping mechanism used in electrostatic precipitators.

In the industrial cleaning of gases, electrostatic precipitators are widely used to remove from gases, for example flue gases from a boiler, solid particles and dust that would otherwise pollute the atmosphere and the surrounding district. In such precipitators, the gas to be cleaned is passed through an electric field in an electrode system which results in the solid particles acquiring an electric charge and consequently being attracted to and deposited upon electrodes in the system. A build-up of dust on the electrodes quickly reduces the efficiency of the precipitator and it is normal practice to remove dust on the electrodes by submitting the electrode system to periodic mechanical shocks, a process known as "rapping".

A well known rapping system involves a rod which rests on an anvil connected to the bottom of a number of electrodes and which extends upwardly through the electrode system. At its top the rod is provided with a collar which is engageable by a rotating lever which, engaging the collar from below, lifts the collar and thus the rod to the point at which the end of the lever clears the edge of the collar. The rod is then free to drop as a hammer and impacts upon the anvil causing mechanical shock waves and vibration in the electrode system of sufficient intensity to dislodge dust on the electrodes, the dust falling to the bottom of the precipitator for removal. This system is extremely efficient and simple but has no means of adjusting the intensity of the rapping. A rapping system incorporating a drop rod-cam arrangement substantially as described is illustrated in FIG. 4 of International Publication No. WO 80/02118, published Oct. 16, 1980.

Due to changes in the dust or any need for a more rigorous clean down then a temporary increase in the rapping blow may be desirable.

It is an object of the present invention to provide a simple rapping mechanism in which the intensity of rapping is adjustable.

The present invention is a rapping mechanism comprising a drop rod having a collar at the upper end thereof, means for raising and releasing the drop rod to apply a rapping impact, and adjusting means for varying the force of the impact independently of the amount by which the drop rod is raised.

Figure 1:
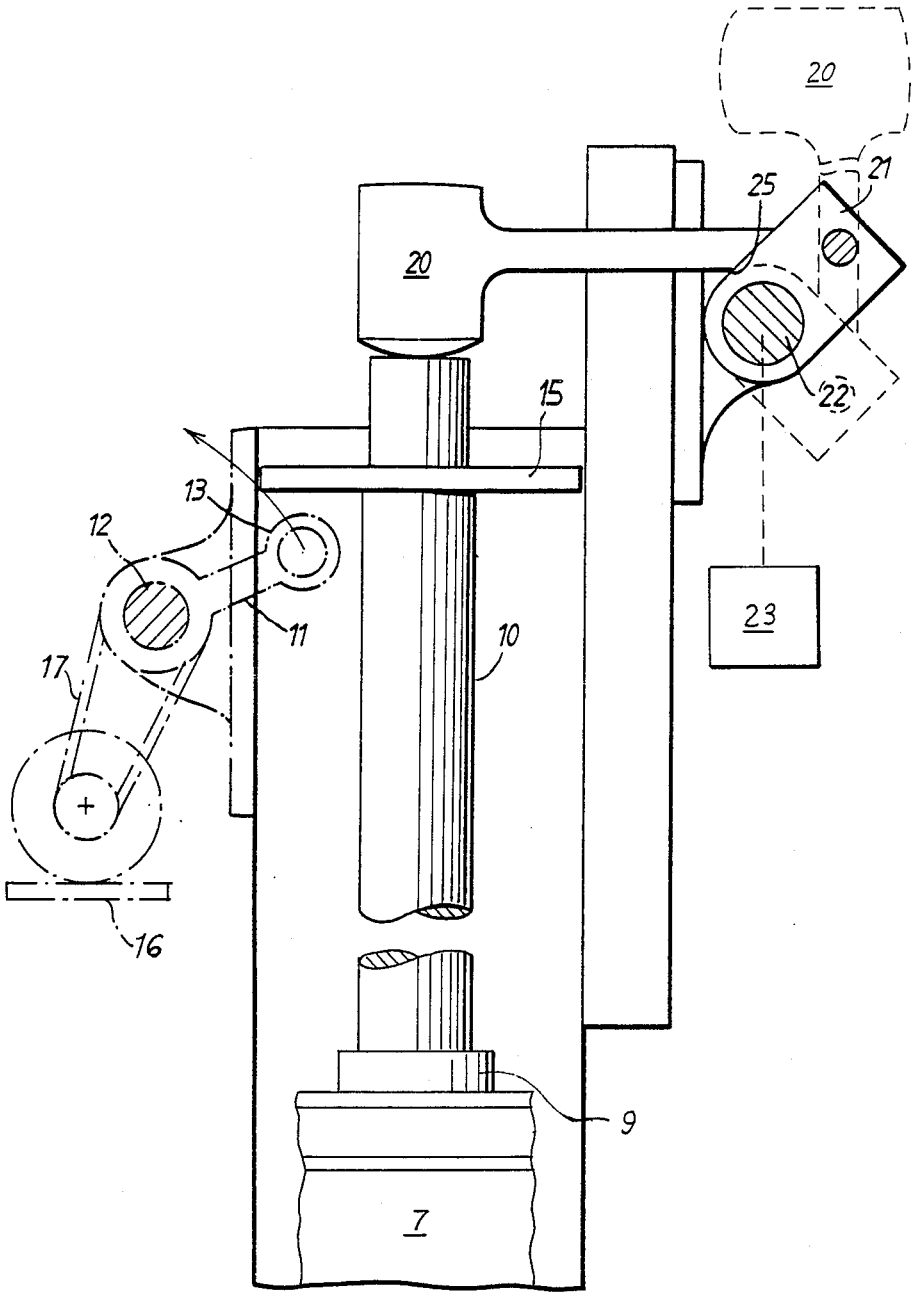
Figure 2:
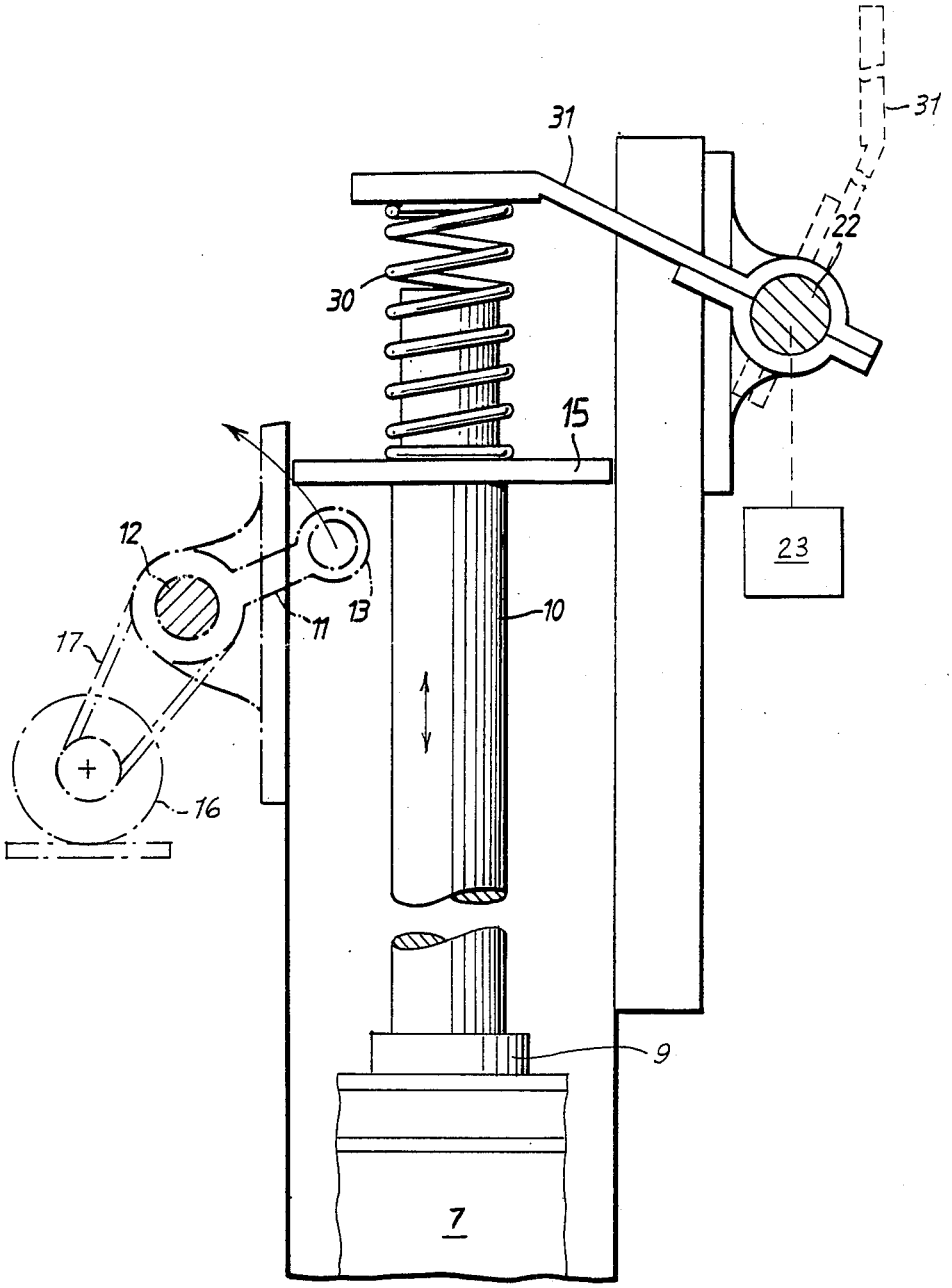

Embodiments of the present invention will now be described, by way of example, with reference to the accompanying drawings, in which:

FIG. 1 is a schematic elevation of a first embodiment of a rapping mechanism according to the present invention; and FIG. 2 is a schematic elevation of a second embodiment of a rapping mechanism according to the present invention.

Referring now to FIG. 1, the top end of a drop rod 10 is illustrated together with a conventional cam lifter comprising an arm 11 rotatable anticlockwise as seen in FIG. 1 by a shaft 12 and carrying at its free end a roller 13. A motor 16 is illustrated as driving the shaft 12 through a drive arrangement 17. As the shaft 12 rotates the roller 13 is brought into engagement with the underside of the collar 15 on the drop rod 10 to lift the collar and drop rod until the roller 13 is able to pass out from beneath the collar at which time the drop rod simply drops onto its anvil 9 to provide a rapping impact.

At the top of the drop rod is a weight, in this embodiment a tumble hammer 20 pivotally mounted on a bracket 21 which is in turn rotatable on a drive shaft 22. The drive shaft is remotely driven and has only a limited rotation, e.g. about a quarter turn clockwise from the position illustrated and back. The quarter turn rotation of the hammer 20 is caused by motive means 23 which is illustrated as being attached to the shaft 22 by a dash line.

In the position shown the hammer 20 is free to rotate clockwise as the drop rod is raised and to fall back with the drop rod to increase the rapping force because of the increased dropping mass. If the shaft 22 is rotated the quarter turn clockwise (dash line position of FIG. 1) the hammer 20, engaging a stop 25 in the bracket 21, is also turned clockwise to be out of the line of the drop rod and therefore ineffective.

The remotely driven shaft 22 extends along a line of drop rods and is provided with a bracket and tumble hammer for each drop rod in the line so that the rapping force of every drop rod may be changed simultaneously.

Referring now to FIG. 2, the tumble hammer of FIG. 1 is replaced by a spring 30 located between the collar 15 and a spring retaining arm 31 secured to the drive shaft 22. The operation of the FIG. 2 embodiment is similar to that of FIG. 1; in the position shown the spring is compressed as the drop rod is raised and, upon release of the drop rod, forces the rod down to increase the rapping force. If the spring retaining arm is moved out of the line of the drop rod by clockwise rotation of the shaft 22 then the spring is ineffective (see dash line position of FIG. 2). As was true of the rapping device of FIG. 1, the shaft 22 of FIG. 2 may also be rotated a quarter turn clock-wise and counter-clockwise by motive means 23.

A difference between the embodiments of FIGS. 1 and 2 is that the spring can also be effective in intermediate positions of the retaining arm. For example, if the spring retaining arm is lifted slightly then the spring will be less effective as it will store less energy as the drop rod is raised to compress the spring and can therefore return less energy to the drop rod when the rod is released. This use of intermediate positions of the lever arm is of course subject to limitations in terms of support for the spring ends and the spring's line of action, and may involve a more complicated design of lever arm to ensure that the end of the arm engaged by the spring remains nearly horizontal throughout the intended useful rotation of the arm.

It should also be noted that in both embodiments the variation in the impact force is independent of the amount by which the drop rod is raised, i.e. for a given lift of the drop rod, different impact forces may be achieved. Both embodiments permit the impact force to be varied without interrupting operation of the precipitator.

I claim:

1. An improved rapping mechanism for use in an electrostatic precitator which includes an electrode support therefore, a drop rod having a collar near the upper end thereof, means engageable with the collar for raising and dropping the rod to strike the support applying a rapping impact to the electrode, the improvement comprising means engageable with the drop rod for movement with the drop rod for increasing the impact force applied by the drop rod independently of the amount by which the drop rod is raised.

2. A rapping mechanism as claimed in claim 1, in which said means engageable comprises a weight and means for adding the weight to the weight of the drop rod as it falls.

3. A rapping mechanism as claimed in claim 2, in which the weight is a tumble hammer connected to a drive shaft rotatable to move the hammer out of engagement with the drop rod.

4. A rapping mechanism as claimed in claim 3, in which said drive shaft is connected to the means engageable for other rapping mechanisms.

5. A rapping mechanism as claimed in claim 1, in which said adjusting means engagable comprises a spring and a retaining arm, the spring being retained between the collar and the retaining arm and applying to the rod as it drops a force depending on the position of the retaining arm.

6. A rapping mechanism as claimed in claim 5, in which said retaining arm is secured to a drive shaft rotatable to move the retaining arm clear of the line of action of the drop rod.

7. A rapping mechanism as claimed in claim 6, in which said drive shaft is connected to the means engageable for other rapping mechanisms.

* * * * *

UNITED STATES PATENT AND TRADEMARK OFFICE

CERTIFICATE OF CORRECTION

PATENT NO. : 4,767,423

DATED : August 30, 1988

INVENTOR(S) : Alan P. Baylis

It is certified that error appears in the above-identified patent and that said Letters Patent is hereby corrected as shown below:

Column 2, Line 62, after "electrode" insert a comma.

Column 4, Line 2, delete "adjusting".

Signed and Sealed this

Third Day of October, 1989

*Attest:*

DONALD J. QUIGG

*Attesting Officer*

*Commissioner of Patents and Trademarks*